United States Patent [19]

Harper, Jr. et al.

[11] 4,194,032

[45] Mar. 18, 1980

[54] TRANSFER TECHNIQUES FOR PRODUCING FLAME RETARDANT COTTON FABRICS

[75] Inventors: Robert J. Harper, Jr.; Timothy A. Calamari, Jr.; Sidney P. Schreiber, all of Metairie, La.

[73] Assignee: The United States of America as represented by the Secretary of Agriculture, Washington, D.C.

[21] Appl. No.: 555,486

[22] Filed: Mar. 5, 1975

[51] Int. Cl.[2] ..... B05D 3/10

[52] U.S. Cl. ..... 427/341; 427/342; 427/353; 427/382; 427/392; 427/428; 427/429; 428/921; 427/393.3

[58] Field of Search ..... 427/341, 428, 429, 390 D, 427/392, 382, 353, 342; 428/DIG. 920, DIG. 921; 118/257

[56] References Cited

U.S. PATENT DOCUMENTS

| | | | |
|---|---|---|---|
| 2,772,188 | 11/1956 | Reeves et al. | 427/341 |
| 2,859,133 | 11/1958 | Olcott | 427/428 |
| 2,865,783 | 12/1958 | Henderson et al. | 427/428 |
| 3,236,676 | 2/1966 | Coate et al. | 427/381 |
| 3,276,897 | 10/1966 | Reeves et al. | 427/341 |
| 3,310,420 | 3/1967 | Wagner | 427/341 |
| 3,607,356 | 9/1971 | Beninate et al. | 428/921 |
| 3,784,356 | 1/1974 | Wagner | 427/390 |

*Primary Examiner*—Ronald H. Smith
*Assistant Examiner*—Janyce A. Bell
*Attorney, Agent, or Firm*—M. Howard Silverstein; David G. McConnell; Salvador J. Cangemi

[57] ABSTRACT

Flame resistance sufficient to enable cellulose containing materials to pass modern flammability standards has been imparted to these materials by application of an aqueous solution containing a methylol phosphorus compound followed by heat drying to about 15% or less moisture content, and finally by polymerizing the phosphorus material in the cellulose containing material by any one of several indirect aqueous ammonia curing techniques. The invention provides an improved process for flame proofing cellulosic materials which avoids the use of ammonia gas during the cure and which results in little or no loss in tensile strength or in an undesirable change in hand. Cellulosic textiles treated by this process retain their flame resistant properties after repeated laundering.

14 Claims, 4 Drawing Figures

TRANSFER TECHNIQUES FOR PRODUCING FLAME RETARDANT COTTON FABRICS

Figure 1:
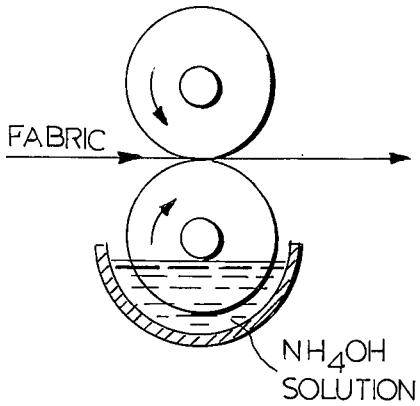

This invention relates to compositions for treating cellulosic materials, to a process for the preparation of flame retardant cellulosic materials, and to the compositions produced thereby.

Specifically, this invention relates to the treatment of cellulose-containing textiles with an aqueous solution containing a methylol phosphorus compound and fixation of a polymer in the cellulosic fibers by use of ammonium hydroxide or an aqueous solution of an ammonium salt. The process intentionally avoids the use of ammonia gas during the entire operation. The process is particularly useful in rendering cellulosic textiles sufficiently flame resistant to pass modern flammability standards. The treated textiles exhibit high strength retention, often as much or more than untreated control fabric, and flame resistance durable to repeated laundering.

Methylol phosphorus based polymers which have nitrogen atoms incorporated in the polymers are known to have excellent flame-retardant properties. Such polymers are particularly suitable in the treatment of cellulosic materials such as cotton, rayon, jute, ramie, paper, cardboard, and the like. Numerous processes have been developed for treating cellulosic materials with such polymers. For example, in one process, a cellulosic material such as cotton fabric is impregnated with an aqueous solution containing tetrakis(hydroxymethyl)-phosphonium chloride (Thpc), a cyclic-nitrogen containing compound such as methylol melamine and urea, the impregnated cloth is dried and then heated at an elevated temperature of about 150° C. [U.S. Pat. No. 2,668,096, Am. Dyestuff Reporter 44 328 (1955)].

It is also known that ammonia reacts with partially or completely neutralized Thpc to produce adducts and polymers. For example, in the prior art (U.S. Pat. No. 3,236,676), cellulosic materials are impregnated with partially or fully neutralized Thpc and heated at a high temperature or alternately at a lower temperature for a longer time period to place the Thpc in the cellulosic fiber. Subsequently, the thoroughly dried textile is exposed to ammonia. In another process (U.S. Pat. No. 3,607,356), the cellulosic material is impregnated with tris-hydroxymethyl phosphine (THP) or fully neutralized Thpc (pH of 7 or above), then the cellulosic material is partially dried and exposed to ammonia gas to produce insoluble flame-retardant polymer in the textiles.

The efficiency of polymer formation in a cellulosic textile is very low when the textile is impregnated with Thpc and the dried textile is subsequently exposed to ammonia. Thpc which is strongly acidic (pH about 2) reacts slowly with ammonia, and amides to produce insoluble polymers. Reaction is accelerated or promoted by partial or complete neutralization (pH about 7.5) with a base. Therefore, such a process without neutralization is not a satisfactory commercial method for imparting flame resistance to textiles. Besides, much of the flame retardant is removed by laundering. When Thpc is partially or fully neutralized with a base and applied to fabric as above, polymer formation is efficient when the dried or partially dried fabric is exposed to ammonia gas.

The standard procedure used for the commercial production of THPOH-$NH_3$ finished flame retardant cotton fabrics involves the use of ammonia gas as curing agent. From the viewpoint of the textile industry, the use of ammonia gas poses several disadvantages. First, the industry is currently equipped to treat fabric using aqueous systems to impart finishing chemicals to fabric. In order to use ammonia gas, special curing chambers must be designed, built and placed in a finishing line. To permit operation at modern finishing speeds, these chambers are large and costly. Because the fabric is passing through these chambers in a continuous manner, it is not possible to completely seal these chambers. As such, there is a tremendous loss of ammonia from the chambers so that the plant atmosphere poses a health hazard to the workers. Indeed, this odor is often so permeating that only people wearing gas masks can stay in the immediate vicinity of the operation. The rapid escalation of ammonia prices has made the loss of ammonia in the air, an economic consideration as well as a health factor. Also, a basic gas floating around a textile mill poses an added problem because most operations are acid catalyzed and there is a potential for interference with these catalysts. In addition, the necessity for gas to penetrate to all regions of the fabric would appear to raise a problem with respect to evenness of treatment in high speed operations. Modern flammability test requirements are such that each and every sample of treated fabric must be able to pass the bone dry flammability test, i.e., Children's Sleepwear Standard, DOC FF 3-71, Fed. Register, July 29, 1971. Finally, because the use of gas finishing techniques represents an entire new technology to most textile companies, there is a reluctance on their part to produce products which require new technology and new equipment.

For these reasons, it was deemed advantageous for the ammonia to be added to an aqueous phase in the form of ammonium hydroxide or other ammonium salts. Previous attempts to do this by running a fabric treated with THPOH into an aqueous system containing ammonium hydroxide were unsatisfactory for several reasons. First, the THPOH is water soluble and much of the THPOH on the fabric would be leached into the aqueous bath, where a polymer quickly forms. This polymer is deposited both in the bath and on the squeeze rolls, thus interfering with bath life and roller efficiency. A second consequence of this leaching is that the treated fabric now has insufficient polymer to pass the flammability tests. To demonstrate this, several experiments were performed which would indicate typical results from the various approaches. Thus, two samples of cotton fabric were padded with 35% THPOH and dried. One sample was ammoniated as described by Beninate et al. (U.S. Pat. No. 3,607,356) and gave a phosphorus analysis of 5.8% (subsequent to oxidation). By contrast the companion sample was padded with $NH_4OH$ and then oxidized. This latter sample had a phosphorus analysis of 1.5%. A phosphorus content of 3.5%–4.0% is required to produce a fabric which will pass the modern flammability test initially and after 50 launderings. Thus, it can be seen that taking a sample of THPOH fabric and padding or putting in through a bath of $NH_4OH$ does not produce a flame-retardant fabric.

We have discovered that by using the known devices of FIGS. 1, 2, 3 or 4 we obtain a process for achieving good phosphorus fixation without the difficulties and deficiencies normally associated with ammonium hydroxide solutions. Referring to the FIGURES:

FIG. 1 discloses the device employed in the kiss role process.

Figure 2:
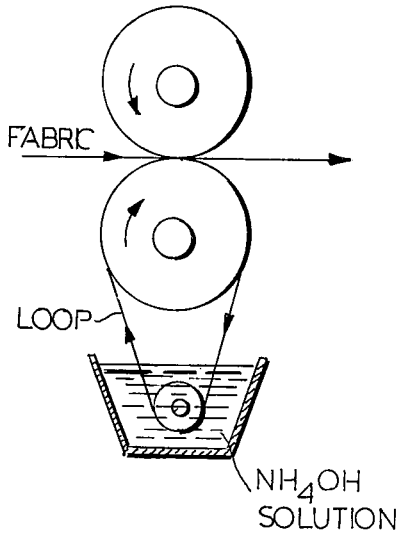

FIG. 2 shows the device employed in the two-roll pad, loop transfer process.

Figure 3:
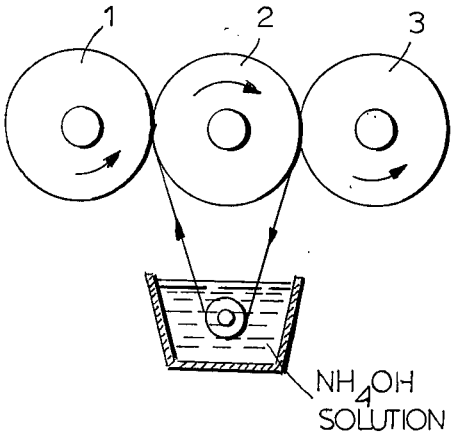

FIG. 3 discloses the device employed in the three-roll pad, loop transfer process.

Figure 4:
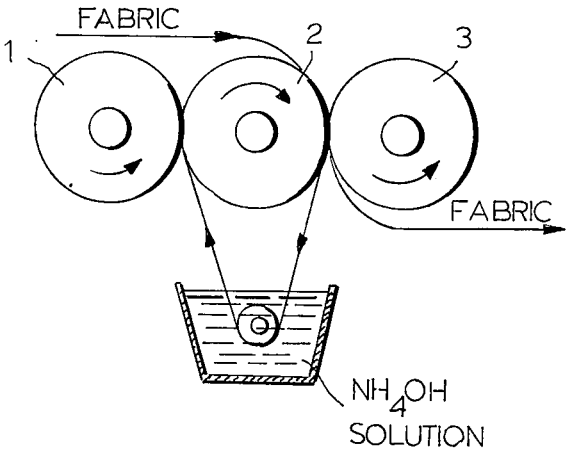

FIG. 4 demonstrates the operation of the device of FIG. C in the three-roll pad, loop transfer process.

This process consists of fixing methylol phosphorus compounds in cellulosic materials with either ammonium hydroxide or aqueous solutions of ammonium salts. This method involves the use of an indirect transfer technique in which the ammonium curing solution is transferred in limited quantities to dry cotton fabric containing methylol phosphorus compound. This transfer can be achieved by either of two general methods. In one, the ammonium hydroxide solution is brought to and squeezed into the fabric to be cured as shown in FIG. A1. In the second method, a looped fabric is used on either a two- or three-roll padder, and the ammonium hydroxide solution transferred from the pad bath to the solution to be cured by means of the fabric loop. When a two-roll padder is used with a fabric loop, as shown in FIG. B2, the loop first passes through the ammonium hydroxide in the pad bath, then is squeezed between the pair of rolls along with the fabric to be cured, so that a limited amount of ammonium hydroxide is transferred from the wet loop to the dry fabric containing the THPOH. When a three-roll padder is used with a fabric loop, as shown in FIG. 3, the loop first passes through the ammonium hydroxide in the pad bath, then is squeezed between the first and second rollers to remove excess ammonium hydroxide solution. The loop then passes between the second and third rollers along with the fabric to be cured as shown in FIG. 4, so that a limited amount of ammonium hydroxide is transferred from the wet loop to the dry fabric containing the THPOH. In this application the term "kiss roll padding" will be used to refer to the transfer of chemical agent using a kiss roll, the term "loop transfer" will refer to the transfer of chemical agent using a fabric loop on either a two- or three-roll pad, and the term "padding" will refer to the conventional immersion of fabric in a solution of chemical agent followed by the squeezing of the wet fabric between a set of rollers to remove excess solution.

After the initial transfer of ammonium agent to the fabric via either a fabric loop or kiss roll, the fabric can be dried and polymer add-on and durability can be augmented by a subsequent treatment with ammonium hydroxide. Because the initial transfer technique fixes the polymer in place, this second treatment can be done by kiss roll padding, transfer padding with a loop or by immersion padding. Kiss roll padding and loop transfer padding eliminate the back transfer of phosphorus agent to the ammonia bath, prevent formation of polymer in the treating bath and produce high phosphorus levels on the fabric to be treated. As a consequence of this, flame retardant fabric containing 5–7% phosphorus have been produced by these methods. This contrasts with comparable values of 5.8% for the gaseous treatment and 1.5% for the padding treatments previously noted in this application. In addition to elimination of leaching, another significant element in these transfer techniques is the limited amount of water introduced by these transfer padding techniques. The amount, of course, is a function of belt fabric, squeeze roll pressures and depth of kiss roll in solution. Nevertheless, wet pick-ups in the range from 15–50% were achieved by these methods. This contrasts with a normal fabric wet pick-up of 80–90% in padding operations. In view of the statements by Beninate et al. (U.S. Pat. No. 3,607,356) with respect to moisture content, the advantages of transfer techniques can be readily seen.

It is the object of this invention to provide a novel process for producing durable flame retardant cellulose-containing materials capable of passing modern flammability standards (DOC FF 3-71)

A further object is to provide a novel means for eliminating the need for ammonia gas during the fixation of methylol phosphorus based flame retardant to cellulose-containing materials so that conventional processing equipment can be used.

Another object of this invention is to provide durable flame retardant cellulosic textiles having essentially the tensile properties of untreated control textiles.

Another object of this invention is to provide an efficient and rapid method of producing flame retardant cellulose-containing materials without the need for gaseous ammonia, a catalyst, or a heat cure.

The detailed procedure in accordance with this invention comprises the following steps:

1. Add sufficient alkali metal hydroxide to a solution of methylol phosphorus compound to adjust the pH to within the range of 6.7 to 7.5. The amount of methylol phosphorus compound (MPC) in solution can be varied according to the amount of phosphorus-containing polymer that is desired in the final treated textile.

2. Impregnate a cellulose-containing textile with the MPC solution described above in step 1.

3. Partially or completely dry the impregnated cellulose-containing textile at a temperature not to exceed 120° C.

4. Expose the dried textile to a limited amount of either ammonium hydroxide or aqueous ammonium salt solutions through the use of kiss roll padding or transfer padding with a fabric loop.

5. Partially or completely dry the impregnated cellulose-containing textile at a temperature not to exceed 120° C.

6. Reexpose the dried textile to additional ammonium hydroxide either by transfer pad or direct pad techniques.

7. Process wash then oxidize the polymer by exposure of the treated textile to an oxidizing solution.

Methylol phosphorus compounds suitable for use in this invention have the following formula:

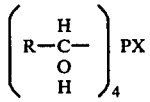

where X is a halogen, acetate, sulfate, oxalate, or phosphate and R is selected from the group consisting of hydrogen, alkyl having from one to three carbon atoms, and halo alkyls having from one to three carbon atoms.

The textile treating solutions suitable for use in this invention are prepared by adding a solution of an alkali metal hydroxide to a solution of the methylol phosphorus compound. Hydroxides suitable for use in this invention are soluble hydroxides selected from the group consisting of sodium, potassium, lithium, magnesium and calcium. Sodium and potassium hydroxides are the preferred bases. The mole ratio of base to MPC should be in the range of 0.7/1.0 to 0.9/1.0. The efficiency of polymer formation with ammonium hydroxide or with aqueous solutions of ammonium salts is highest in this the mole ratios of base to MPC specified above. Depending on the source of the MPC, the pH of the pad bath will vary from about 6.9 to 7.5 but any value within this range is suitable for use in this invention.

Cellulose-containing textiles suitable for use in this invention include products made from cotton, rayon, jute, ramie, and paper, and products which contain a major portion of these fibers along with minor portion of such fibers as those made of polyesters, polyamides, polyacrylics, wool, and polypropylene. The fibrous textile materials are impregnated with solutions of the methylol phosphorus compound using various techniques including padding, spraying, immersing, and centrifuging and the like conventional textile processing methods. The amount of methylol phosphorus compound applied to the textile material is dependent upon the amount of durable flame retardant to be developed in the textile product. Generally, the amount of methylol phosphorus compound applied to the textile structure will range from about 5% up to about 35%, with the higher portion of the range being used where it is necessary to pass modern flammability tests.

The textile material which has been impregnated with the neutralized methylol phosphorus compound solution can be partially or completely dried by any of several conventional processes. The textile structures can be dried at temperatures up to about 120° C.

The dried or partially dried textile structure is exposed to limited amounts of ammonium hydroxide or aqueous solutions of ammonium salts by any one of several previously described transfer padding techniques.

Investigation has shown that there are a wide variety of effective procedural options available in finishing with these techniques. Thus, treated and untreated cotton, polyester-cotton and other blends have been used as the fabric loop. All that is required is that the fabric wet out readily and evenly and that the loop readily transfer liquid solution to the fabric being treated. Particularly effective loops were of a 1×1 all-cotton flat rib knit, weighing 17 oz./sq.yd. and light weight interlock knits. With respect to the process, a single pass over the loop is sufficient to achieve a high phosphorus add-on (4–6%). However, in order to ensure that all portions of the fabric have received a sufficient amount of $NH_4OH$, the fabric is frequently put back in contact with $NH_4OH$. This second pass can be via a fabric loop using a 3-roll pad, fabric loop using a 2-roll pad, immersion pad in ammonium hydroxide or a kiss roll technique. At this point, it might be noted that the immersion pad is effective because the initial pad has fixed the polymer in place.

In most cases, experimental results indicate that satisfactory performance can be achieved with one or two contacts with $NH_4OH$. The latter would seem to be preferred because it would facilitate even distribution of the polymer throughout the fabric.

However, where very low wet pickups were obtained with the initial kiss roll or loop transfers of $NH_4O_4$ to the THPOH sensitized fabrics, repeated kiss roll and loop transfers were found to be beneficial. Subsequent to this initial phase of the treatment, the fabric may be dried (either immediately or after a time delay), then put through a standard immersion pad in an ammonium hydroxide solution to achieve maximum fixation of the phosphorus and nitrogen containing polymer.

Examples of procedures used for ammoniation of fabric sensitized with THPOH are the following:

A. A conc. $NH_4OH$ solution was transfer padded to the THPOH sensitized fabric using a heavy cotton twill loop (19% WPU). The fabric was immediately dried. Phosphorus analysis of oxidized and washed fabric 5.3%. The same procedure using a cotton knit loop gave fabric with 4.5% phosphorus while with a cotton sheeting loop phosphorus was 5.87.

B. A conc. $NH_4OH$ solution was transfer padded to the THPOH sensitized fabric using a heavy cotton twill loop. The fabric was dried and retransfer padded with 50% conc. $NH_4OH$ solution using a sheeting loop on the 2-roll pad. The fabric was dried, oxidized and laundered. Phosphorus content was 5.2%. With sheeting loops on both pads and 50% conc. $NH_4OH$ in bath solution, phosphorus content of finished fabric was 5.5%.

C. A conc. $NH_4OH$ solution was transfer padded to THPOH sensitized fabric using a sheeting loop. Without drying, a 2-roll pad and sheeting loop were used to transfer pad 50% conc. $NH_4OH$ to the fabric. The fabric after drying and oxidation had a phosphorus content of 5.0%. An equivalent phorphorus content was achieved when 50% conc. $NH_4OH$ was used in the 3-roll pad.

D. A conc. $NH_4OH$ solution was transfer padded to THPOH sensitized fabric using 65% polyester-35% cotton blended loop on the 3-roll pad. The fabric was dried, conventionally padded without a loop with 50% conc. $NH_4OH$ and redried. Phosphorus content was 5.7%. The same procedure using 100% cotton loops and 50% conc. $NH_4OH$ in both baths gave a product with 5.5% phosphorus content.

E. A conc. $NH_4OH$ solution was transfer padded to THPOH sensitized fabric using a 1-1 flat rib knit on the 3-roll pad. The fabric was dried, and again transfer padded on the 3-roll pad as in the first step. The fabric was redried, oxidized and laundered. It had a phosphorus content of 5.4%.

F. A conc. $NH_4OH$ solution was transferred to a THPOH sensitized fabric using a kiss roll. The fabric was dried, oxidized and laundered. Phosphorus content was 5.7%. With two kiss roll applications prior to drying, the finished product had a phosphorus content of 5.4%.

G. A conc. $NH_4OH$ solution was transfer padded to THPOH-sensitived fabric using a cotton 1×1 flat rib knit loop on a 3-roll pad. Without drying, the fabric was turned over and conc. $NH_4OH$ solution again was transferred to it using the rib knit loop on a 3-roll pad. The treated fabric was allowed to sit for 90 minutes. The fabric after drying and oxidizing had a phosphorus content of 6.7%.

H. The THPOH sensitized fabric may be treated several times by padding over the kiss roll, or it may be padded only once on the kiss roll then run through a conventional ammonium hydroxide dip to complete the polymerization. A delay of about fifteen seconds is required between the original transfer of ammonium hydroxide or aqueous ammonium salt solution from the kiss roll and subsequent ammonium hydroxide dips, since the initial fixation reaction is not complete prior to this time. No catalyst is required for this reaction. Neither is a heat cure required. Heat may be employed during an intermediate drying step; however, this step is not required.

As these results show, a wide range of procedures can be employed to achieve the transfer of $NH_4OH$ and the ensuing polymerization. In addition to $NH_4OH$, good results have also been achieved with ammonium acetate in the fabric bath.

The amount of ammonium hydroxide or ammonium salt solution to be applied to the impregnated fabric is dependent upon the amount of methylol phosphorus compound in the textile structure. Generally, the amount of ammonia moiety needed is one mole per mole of methylol phosphorus compound.

After the textile has been exposed to ammonium hydroxide or aqueous ammonium salt solution to produce an insoluble polymer, it is desirable to treat the textile with an oxidizing agent. The purpose of this oxidation is to oxidize trivalent phosphorus to pentavalent phosphine oxide. The oxidation removes any odor that might be present; it bleaches and prevents subsequent yellowing of the fabric; it improves durability of the flame retardant to laundering with or without hypochlorite bleaches and improves the durability of the retardant to sunlight and also increases the flame retardancy contributed by the polymer. In the oxidation process the fabric can be immersed in the oxidizing solution for one to about three minutes then rinsed, or the fabric may be padded in the oxidizing solution, then rinsed and dried. Where the textile is padded in the oxidizing agent and rinsed, the concentration of the oxidizing agent should be greater than when the fabric is left in the solution for periods ranging from about one to three minutes. For example, if hydrogen peroxide is the oxidizing agent, the amount of peroxide applied to the fabric during the padding process should be about one equivalent of peroxide per mole of methylol phosphorus compound but should not exceed about four equivalents of peroxide. Other oxidizing agents such as sodium perborate or sodium chlorate may also be used. In these instances, one or more equivalents of oxidant is needed per mole or methylol phosphorus compound fixed in the fabric. To assure essentially complete oxidation, from one to about four equivalents of oxidant is utilized per mole of methylol phosphorus compound.

The examples below are provided to illustrate the invention and are not be construed as limiting the invention in any manner whatever.

EXAMPLE 1

An aqueous solution was prepared by adding with continuous stirring a solution of 114 grams of sodium hydroxide in 500 grams of water to 1034 grams of 75% tetrakis hydroxymethylphosphonium chloride (Thpc) solution. To this solution was added 2 grams of a nonionic wetting agent and sufficient water to adjust the solution weight to 2000 grams. The molar ratio of NaOH/Thpc in this solution was 0.7/1.0. The pH of this solution was 7.0.

A piece of cotton flannelette weighing 4.0 oz. per square yard was impregnated with this solution to give about a 110% wet pickup. The impregnated fabric was dried in a gas fired forced draft oven for about one and one-half minutes at 75° C. The moisture content of this THPOH-sensitized fabric was about 15%.

A concentrated solution of $NH_4OH$ (30% $NH_3$ in $H_2O$), was then transferred to this sensitized fabric using a kiss roll technique as illustrated in FIG. 1. This technique involves the use of a vertical two-roll pad in which the bottom roller is turning in a solution of concentrated ammonium hydroxide. This roller transports solution up to the junction where the upper and lower roller touch. When fabric is passed through this junction or nip, treating solution is transferred from the roll to the fabric.

The wet pickup was 38%. The fabric was then dried at 65° C. for two minutes. It was process washed to remove soluble salts then oxidized with a solution of 2% $H_2O_2$ and 1% sodium silicate at 30° C. for two minutes, rinsed and dried. The treated fabric had a phosphorous content of 4.6% and passed the DOC flame test.

EXAMPLE 2

A sample of THPOH-sensitized 4.0 oz./yd.$^2$ cotton flannelette was prepared as described in Example 1. A concentrated solution of $NH_4OH$ was transferred to this sensitized fabric using an 8.0 oz./yd.$^2$ cotton twill loop on a three-roll pad as illustrated in FIG. 3. This technique employs a three-roll pad and a continuous loop such that the loop picks up curing solution by passing under a submerged bar, travels upward to be squeezed between the first and second rolls to remove excess solution, then travels between the second and third rollers where it comes in contact with the THPOH sensitized fabric and where transfer of ammonium hydroxide is made. Wet pickup was 19%. The fabric was then dried at 65° C. for 1.5 minutes. It was then process washed, oxidized, rinsed and dried as in Example 1. The treated fabric had a weight increase of 26%, a phosphorus content of 5.3%, and passed the DOC flame test.

EXAMPLE 3

This Example is identical to Example 2 except that after transfer of concentrated ammonium hydroxide from the loop on the three roll pad, the sample was dried at 65° C. for 1.5 minutes, then concentrated ammonium hydroxide was again transferred to the treated cotton fabric using the loop on three roll pad. Wet pickup after the initial transfer was 29%. After the second transfer the wet pickup was 40%. The treated fabric had a phosphorus content of 4.5%, and passed the DOC flame test.

EXAMPLE 4

This Example is identical to Example 3 except that the second transfer of ammonium hydroxide was accomplished using the two-roll pad (FIG. 2) and 50% concentrated ammonium hydroxide. The wet pickup after the first transfer was 21.5%. After the second transfer the pickup was 74.6%. After drying, washing, oxidizing, washing, and drying as in Example 1, the treated fabric had a phosphorus content of 5.2% and passed the DOC flame test.

EXAMPLE 5

This Example is identical to Example 3 except that after the initial transfer of concentrated ammonium hydroxide on the three-roll pad, the sample was dried at 65° C. for 1.5 minutes, then immersed in a 50% solution of concentrated ammonium hydroxide for about one second prior to washing, oxidizing, washing and drying as described in Example 1. Wet pickup after the initial transfer of ammonium hydroxide was 32%. After immersion the wet pickup was 66%. The treated fabric had a phosphorus content of 4.7% and passed the DOC flame test.

EXAMPLE 6

This Example is identical to Example 1 except that after initial transfer of concentrated ammonium hydroxide on the kiss roll, the sample was dried at 65° C. for 1.5 minutes, then concentrated ammonium hydroxide again transferred to the treated fabric using a loop technique employing a 17 oz./yd.$^2$ cotton flat 1×1 rib knit on the three-roll pad. The sample was then dried at 65° C. for 1.5 min. The wet pickup after the initial transfer was 37.5%. After transfer from the loop on the 3-roll pad, wet pickup was 35.5%. The sample was then washed, oxidized, washed and dried as described in Example 1. The treated fabric had a phosphorus content of 4.9% and passed the DOC flame test.

EXAMPLE 7

This Example is identical to Example 1 except that after the initial transfer of concentrated ammonium hydroxide on the kiss roll, the sample was dried at 65° C. for 1.5 minutes, then a solution of 50% concentrated ammonium hydroxide was transferred to the treated fabric using a loop technique employing an 8.0 oz./yd.$^2$ cotton twill loop on the two-roll vertical pad. The fabric was then dried at 65° C. for 1.5 minutes. The wet pickup after the initial transfer was 35%. After transfer of 50% ammonium hydroxide from the loop on the two-roll pad the wet pickup was 78%. After washing, oxidizng, washing and drying as in Example 1, the treated fabric had a phosphorus content of 4.8% and passed the DOC flame test.

EXAMPLE 8

This example is identical to Example 1 except that after the initial transfer of concentrated ammonium hydroxide on the kiss roll, the sample was dried at 65° C. for 1.5 minutes, then immersed in a solution of 50% concentrated ammonium hydroxide in water for about one second prior to drying for 1.5 minutes at 65° C., washing, oxidizing, washing, and drying as in Example 1. The wet pickup after the initial transfer was 20%. Afer immersion the pickup was 60%. The treated fabric contained 5.5% phosphorus and passed the DOC flame test.

EXAMPLE 9

This Example is identical to Example 1 except that after the initial transfer of concentrated ammonium hydroxide on the kiss roll, the sample was dried for 1.5 minutes at 65° C., then concentrated ammonium hydroxide was again transferred to the treated fabric using the kiss roll technique. The sample was dried, washed, oxidized, washed and dried as in Example 1. Wet pickup after the first kiss roll transfer of concentrated ammonium hydroxide was 28%. After the second transfer the wet pickup was 32%. The phosphorus content of the treated fabric was 5.8%. It passed the DOC flame test.

EXAMPLE 10

This Example is identical to Example 9 except that the drying step between the first kiss roll transfer and second kiss roll transfer was omitted. Wet pickup after the first kiss roll transfer was 17%. After the second kiss roll transfer the pickup was an additional 15%. The sample was then dried, washed, oxidized, washed and dried as in Example 1. The treated fabric contained 6.4% phosphorus and passed the DOC flame test.

EXAMPLE 11

This Example is identical to Example 4 except that the drying step between the ammonium hydroxide loop transfer on the three-roll pad and the ammonium hydroxide transfer on the two-roll pad was omitted, and that a 4.0 oz./sq. yd. cotton print cloth was used as the loop material. The sample was then dried, washed, oxidized, washed and dried as in Example 1. The treated fabric contained 5.0% P and passed the DOC flame test.

EXAMPLE 12

This Example is identical to Example 3 except that after completion of the second transfer of ammonium hydroxide on the three-roll pad, the treated fabric was placed in a plastic bag in roll form and allowed to react for four hours, and that a 17 oz./sq. yd. 1×1 ribbed cotton knit was used as loop material. The wet pickup after the initial transfer of ammonium hydroxide was 29%. After the second transfer, the wet pickup was 40%. After washing, oxidizing, washing, and drying as in Example 1, the treated fabric has a phosphorus content of 4.9% and passed the DOC flame test.

EXAMPLE 13

A sample of "THPOH" sensitized 4.0 oz./sq. yd. cotton flannelette was prepared as described in Example 1. A 25% aqueous solution of ammonium acetate was transferred to this sensitized fabric using a 4.0 oz./sq. yd. cotton print cloth loop on the three-rolled pad. The fabric was then air dried overnight. It was then passed over a second print cloth loop on the two-roll pad where a 50% aqueous solution of concentrated ammonium hydroxide was applied. The treated fabric was then dried, washed, oxidized washed and dried as in Example 1. The fabric has a phosphorus content of 5.2% and passed the DOC flame test.

EXAMPLE 14

This Example is identical to Example 10 except that a solution of 750 grams of ammonium acetate in 750 grams of concentrated ammonium hydroxide was transferred to the "THPOH" sensitized flannelette during both the first and second kiss roll transfers. The treated fabric contained 4.8% phosphorus and passed the DOC flame test.

EXAMPLE 15

A sample of "THPOH" sensitized 4.0 oz./sq. yd. cotton flannelette was prepared as described in Example 1. A 25% solution of ammonium acetate was applied to the fabric via a kiss roll, the fabric dried and retreated with the same solution of ammonium acetate via the kiss roll and redried. After oxidation, the fabric contained 4.7% phosphorus and passed the DOC test.

EXAMPLE 16

A sample of cotton flannelette was treated with THPOH and ammoniating solutions as in Example 4, except that the ammoniating bath contained 25% ammonium acetate instead of ammonium hydroxide. The resulting fabric contained 4.9 phosphorus and passed the DOC flame test.

EXAMPLE 17

A sample of THPOH-sensitized 4.0 oz./yd.$^2$ cotton flannelette was prepared as described in Example 1. A concentrated solution of $NH_4OH$ was transferred to this sensitized fabric using a cotton 1×1 flat rib knit loop of about 17.0 oz./yd.$^2$ on a three-roll pad as illustrated in FIG. C. Wet pickup was about 12%. The rolled fabric was placed in a plastic bag for 2 hours, then dried for 1.5 minutes at 150° F. on a tenter frame. The fabric was then padded by immersion through 50% conc. ammonium hydroxide. The fabric was then washed, oxidized and washed. The treated fabric had a phosphorus content of 6.4% and passed the DOC flame test.

EXAMPLE 18

This Example is identical to Example 17 except that concentrated $NH_4OH$ was transferred twice to the sensitized fabric. Wet pickup after the first transfer was about 11%. The THPOH-sensitized fabric was then turned over and concentrated $NH_4OH$ transferred to the reverse side of the fabric using the 1×1 rib knit on the three-toll pad. The total wet pickup after this second transfer was 19%. The fabric was then padded by immersion with $NH_4OH$, placed in plastic bag, washed, oxidized and washed as in Example 17. The treated fabric had a phosphorus content of 6.7% and passed the DOC flame test.

We claim:

1. A process for producing flame retardant cotton fabrics, which process comprises:
   (a) padding the fabric with a 30 to 40 weight % solution of tetrakishydroxymethylphosphonium hydroxide,
   (b) drying the fabric from (a),
   (c) kiss roll padding the fabric from (b) with an aqueous solution of ammonium hydroxide to a fabric wet pickup of from 5-40 weight %,
   (d) drying the said fabric from (c),
   (e) oxidizing the fabric from (d).

2. A process for producing flame retardant cotton fabrics, which process comprises:
   (a) padding the fabric with a 30 to 40 weight % solution of tetrakishydroxymethylphosphonium hydroxide, (b) drying the fabric from (a),
   (c) loop transfer padding onto the fabric from (b), an aqueous solution of ammonium hydroxide to a wet pickup of from 5 to 50%,
   (d) drying the fabric from (c),
   (e) oxidizing the fabric from (d).

3. A process for producing flame retardant cotton fabrics, which process comprises:
   (a) padding the fabric with a 30 to 40 weight % solution of tetrakishydroxymethylphosphonium hydroxide,
   (b) drying the fabric from (a),
   (c) loop transfer padding onto the fabric from (b), an aqueous solution of hydroxide, so that fabric wet pickup is from 5 to 50%,
   (d) drying the fabric from (c),
   (e) loop transfer padding onto the fabric from (d), an aqueous solution of ammonium hydroxide, so that fabric wet pickup is from 5 to 50%,
   (f) drying the fabric from (e),
   (g) oxidizing the fabric from (f).

4. A process for producing flame retardant cotton fabrics, which process comprises:
   (a) padding the fabric with a 30 to 40 weight % solution of tetrakishydroxymethylphosphonium hydroxide,
   (b) drying the fabric from (a),
   (c) loop transfer padding onto the fabric from (b), an aqueous solution of ammonium hydroxide, so that fabric wet pickup is from 5 to 50%,
   (d) drying the fabric from (c),
   (e) padding the fabric from (d) through a bath containing an aqueous solution of ammonium hydroxide,
   (f) drying the fabric from (e),
   (g) oxidizing the fabric from (f).

5. A process for producing flame retardant cotton fabrics, which process comprises:
   (a) padding the fabric with a 30 to 40 weight % solution of tetrakishydroxymethylphosphonium hydroxide,
   (b) drying the fabric from (a),
   (c) kiss roll padding the fabric from (b) with an aqueous solution of ammonium hydroxide, so that the fabric wet pickup is from 5–40%,
   (d) drying the said fabric from (c),
   (e) loop transfer padding onto the fabric from (d), an aqueous solution of ammonium hydroxide, so that fabric wet pickup is from 5 to 50%,
   (f) drying the fabric from (e),
   (g) oxidizing the fabric from (f).

6. A process for producing flame retardant cotton fabrics, which process comprises:
   (a) padding the fabric with a 30 to 40 weight % solution of tetrakishydroxymethylphosphonium hydroxide,
   (b) drying the fabric from (a),
   (c) kiss roll padding the fabric from (b) with an aqueous solution of ammonium hydroxide, so that the fabric wet pickup is from 5–40%,
   (d) drying the said fabric from (c),
   (e) padding the fabric from (d) by immersion in a bath containing an aqueous solution of ammonium hydroxide,
   (f) drying the fabric from (e),
   (g) oxidizing the fabric from (f).

7. A process for producing flame retardant cotton fabrics, which process comprises:
   (a) padding the fabric with a 30 to 40 weight % solution of tetrakishydroxymethylphosphonium hydroxide,
   (b) drying the fabric from (a),
   (c) kiss roll padding the fabric from (b) with an aqueous solution of ammonium hydroxide, so that the fabric wet pickup is from 5–40%,
   (d) drying the said fabric from (c),
   (e) Kiss roll padding the fabric from (d) with an aqueous solution of ammonium hydroxide, so that the fabric wet pickup is from 5–40%,
   (f) drying the said fabric from (e),
   (g) oxidizing the fabric from (f).

8. A process for producing flame retardant cotton fabrics, which process comprises:
   (a) padding the fabric with a 30 to 40 weight % solution of tetrakishydroxymethylphosphonium hydroxide,
   (b) drying the fabric from (a),
   (c) kiss roll padding the fabric from (b) with an aqueous solution of ammonium hydroxide, so that the fabric wet pickup is from 5–40%,
   (d) kiss roll padding the fabric from (c) with an aqueous solution of ammonium hydroxide, so that fabric total wet pickup is from 15 to 70%,
   (e) drying the fabric from (d),
   (f) oxidizing the fabric from (e).

9. A process for producing flame retardant cotton fabrics, which process comprises:

(a) padding the fabric with a 30 to 40 weight % solution of tetrakishydroxymethylphosphonium hydroxide, (b) drying the fabric from (a), (c) loop transfer padding onto the fabric from (b) an aqueous solution of ammonium hydroxide, so that fabric wet pickup is from 5 to 50%, (d) loop transfer padding to the fabric from (c) with an aqueous solution of ammonium hydroxide, so that total fabric wet pickup is from 10 to 90%, (e) drying the fabric from (d), (f) oxidizing the fabric from (e).

10. A process for producing flame retardant cotton fabrics, which process comprises:

(a) padding the fabric with a 30 to 40 weight % solution of tetrakishydroxymethylphosphonium hydroxide, (b) drying the fabric from (a), (c) loop transfer padding onto the fabric from (b) an aqueous solution of ammonium hydroxide, so that fabric wet pickup is from 5 to 50%, (d) drying the fabric from (c), (e) loop transfer padding onto the fabric from (d) an aqueous solution of ammonium hydroxide, so that fabric wet pickup is from 5 to 50%, (f) placing the fabric roll from (e) in a plastic bag and allowing it to sit for four hours, (g) oxidizing the fabric from (f).

11. A process for producing flame retardant cotton fabrics, which process comprises:

(a) padding the fabric with a 30 to 40 weight % solution of tetrakis (hydroxymethyl) phosphonium hydroxide, (b) drying the fabric from (a), (c) loop transfer padding onto the fabric from (b) an aqueous solution of ammonium acetate so that fabric wet pickup is from 5 to 50%, (d) drying the fabric from (c), (e) loop transfer padding onto the fabric from (d) an aqueous solution of ammonium hydroxide, so that fabric wet pickup is from 10 to 80%, (f) drying the fabric from (e), (g) oxidizing the fabric from (f).

12. A process for producing flame retardant cotton fabrics, which process comprises:

(a) padding the fabric with a 30 to 40 weight % solution of tetrakishydroxymethylphosphonium hydroxide, (b) drying the fabric from (a), (c) kiss roll padding the fabric from (b) with an aqueous solution containing both ammonium hydroxide and ammonium acetate, so that fabric wet pickup is from 5 to 40%, (d) kiss roll padding onto the fabric from (c) an aqueous solution containing both ammonium hydroxide and ammonium acetate, so that fabric wet pickup is from 10 to 80%, (e) drying the fabric from (d), (f) oxidizing the fabric from (e).

13. A process for producing flame retardant cotton fabrics, which process comprises:

(a) padding the fabric with a 30 to 40 weight % solution of tetrakishydroxymethylphosphonium hydroxide, (b) drying the fabric from (a), (c) kiss roll padding onto the fabric from (b) an aqueous solution of ammonium acetate, so that the fabric wet pickup is from 5–40%, (d) drying the fabric from (c), (e) kiss roll padding onto the fabric from (d) an aqueous solution of ammonium acetate, so that the fabric wet pickup is from 5–40%, (f) drying the fabric from (e), (g) oxidizing the fabric from (f).

14. A process for producing flame retardant cotton fabrics, which process comprises:

(a) padding the fabric with a 30 to 40 weight % solution of tetrakishydroxymethylphosphonium hydroxide, (b) drying the fabric from (a), (c) loop transfer padding onto the fabric from (b), an aqueous solution of ammonium acetate, so that fabric wet pickup is from 5 to 50%, (d) drying the fabric from (c), (e) loop transfer padding onto the fabric from (d) an aqueous solution of ammonium acetate, so that the fabric wet pickup is from 5–50%, (f) drying the said fabric from (e), (g) oxidizing the fabric from (f).

* * * * *